US007614440B2

(12) United States Patent
Muramatsu et al.

(10) Patent No.: US 7,614,440 B2
(45) **Date of Patent: *Nov. 10, 2009**

(54) DIECAST MACHINE AND DIECAST METHOD

(75) Inventors: Naokuni Muramatsu, Nagoya (JP); Akihisa Inoue, Sendai (JP); Hisamichi Kimura, Miyagi-ken (JP)

(73) Assignees: NGK Insulators, Ltd., Nagoya (JP); Tohoku University, Sendai (JP)

( * ) Notice: Subject to any disclaimer, the term of this patent is extended or adjusted under 35 U.S.C. 154(b) by 402 days.

This patent is subject to a terminal disclaimer.

(21) Appl. No.: 11/159,833

(22) Filed: Jun. 23, 2005

(65) Prior Publication Data

US 2007/0215306 A1 Sep. 20, 2007

(30) Foreign Application Priority Data

Jun. 9, 2005 (JP) ..... P2005-170055

(51) Int. Cl.
*B22D 17/12* (2006.01)

(52) U.S. Cl. ..... 164/113; 164/312

(58) Field of Classification Search ..... 164/113, 164/306–318

See application file for complete search history.

(56) References Cited

U.S. PATENT DOCUMENTS 4,100,960 A * 7/1978 Watts ..... 164/119
4,347,889 A * 9/1982 Komatsu et al. ..... 164/250.1
4,616,690 A 10/1986 Demange et al.
5,117,894 A * 6/1992 Katahira ..... 164/113
6,021,840 A 2/2000 Colvin
2003/0068136 A1* 4/2003 Kobayashi et al. ..... 385/70
2003/0230393 A1* 12/2003 Kimura et al. ..... 164/113
2005/0167072 A1* 8/2005 Kim et al. ..... 164/113

FOREIGN PATENT DOCUMENTS

EP 0 875 318 A1 11/1998
JP 11-285801 A1 10/1999

OTHER PUBLICATIONS

"*Monthly Functional Material*." CMC Publication, Jun. 2002, vol. 22, No. 6, pp. 5-9.
"*Monthly Functional Material*." CMC Publication, Jun. 2002, vol. 22, No. 6, pp. 26-31.
Itsuo Ohnaka, et al. "*Melt-processibility*" Corona Publishing, Sep. 1987, pp. 119-120.
Itsuo Ohnaka, et al. "*Melt-processibility*" Corona Publishing, Sep. 1987, pp. 120-122.

* cited by examiner

*Primary Examiner*—Kuang Lin
(74) *Attorney, Agent, or Firm*—Burr & Brown

(57) ABSTRACT

A diecast machine comprises: a sleeve extending in a vertical direction; a plunger moving upward in the vertical direction inside the sleeve; a mold disposed above an upper side of the sleeve; and a metal material heater configured to heat a metal material disposed on the plunger and melting the metal material.

1 Claim, 8 Drawing Sheets

FIG.7

| | Injection direction | Atmos-phere | Number of molding cavity (Number) | Materials of sleeve and plunger tip | Clearance between sleeve and plunger tip (mm) | Injection speed (m/s) | Plunger pressure (Mpa) | Mold tempera-ture (°c) | Thermal conduc-tivity of mold (W/mK) | Number of molded product (Number) | Thickness of molded product (mm) | Filling degree | Appear-ance quality | Amorphous degree (Evaluation degree) |
|---|---|---|---|---|---|---|---|---|---|---|---|---|---|---|
| Com.Ex. 1 | Hori-zontal | Vacuum | 2 | Graphite | 0.01 | 1.0 | 28 | 200 | 40 | 2 | 0.5 | 100% | Fine | G3 |
| Com.Ex. 2 | Vertical | Air | 〃 | 〃 | 〃 | 〃 | 〃 | 〃 | 〃 | 0 | — | Not molded | — | — |
| Com.Ex. 3 | 〃 | Vacuum | 〃 | Die steel | 〃 | 〃 | 〃 | 〃 | 〃 | 0 | 0.5 | 20% | Defective | — |
| Com.Ex. 4 | 〃 | 〃 | 〃 | Graphite | 0.03 | 〃 | 〃 | 〃 | 〃 | 0 | — | Not injected due to melt leak | — | — |
| Com.Ex. 5 | 〃 | 〃 | 〃 | 〃 | 0.01 | 0.05 | 〃 | 〃 | 〃 | 0 | — | Not molded | — | — |
| Com.Ex. 6 | 〃 | 〃 | 〃 | 〃 | 〃 | 2.2 | 〃 | 〃 | 〃 | 2 | 0.5 | 100% | Fine | G2 |
| Com.Ex. 7 | 〃 | 〃 | 〃 | 〃 | 〃 | 1.0 | 3 | 〃 | 〃 | 0 | 〃 | 10% | Defective | G2 |
| Com.Ex. 8 | 〃 | 〃 | 〃 | 〃 | 〃 | 〃 | 70 | 〃 | 〃 | 2 | 〃 | 100% | Fine | G5 |
| Com.Ex. 9 | 〃 | 〃 | 〃 | 〃 | 〃 | 〃 | 28 | 120 | 〃 | 〃 | 〃 | 30% | Defective | G2 |
| Com.Ex. 10 | 〃 | 〃 | 〃 | 〃 | 〃 | 〃 | 〃 | 300 | 〃 | 〃 | 〃 | 100% | Defective | G3 |
| Com.Ex. 11 | 〃 | 〃 | 〃 | 〃 | 〃 | 〃 | 〃 | 200 | 120 | 2 | 0.5 | 60% | Defective | G3 |
| Com.Ex. 12 | | Ar | 〃 | 〃 | 〃 | 4.0 | 〃 | 25 | 40 | 2 | 〃 | 100% | Fine | G1 |

FIG.8

| | Injection direction | Atmos-phere | Number of molding cavity (Number) | Materials of sleeve and plunger tip | Clearance between sleeve and plunger tip (mm) | Injection speed (m/s) | Plunger pressure (Mpa) | Mold tempera-ture (°c) | Thermal conduc-tivity of mold (W/mK) | Number of molded product (Number) | Thickness of molded product (mm) | Filling degree | Appear-ance quality | Amorphous degree (Evaluation degree) |
|---|---|---|---|---|---|---|---|---|---|---|---|---|---|---|
| Ex. 1 | Vertical | Vacuum | 2 | Graphite | 0.01 | 0.1 | 28 | 200 | 40 | 2 | 0.5 | 100% | Fine | G5 |
| Ex. 2 | 〃 | 〃 | 4 | 〃 | 〃 | 1.0 | 〃 | 〃 | 〃 | 4 | 〃 | 〃 | 〃 | G5 |
| Ex. 3 | 〃 | 〃 | 2 | Nitride boron (BN) | 〃 | 〃 | 〃 | 〃 | 〃 | 2 | 〃 | 〃 | 〃 | G5 |
| Ex. 4 | 〃 | 〃 | 2 | Graphite | 〃 | 〃 | 〃 | 〃 | 〃 | 〃 | 〃 | 〃 | 〃 | G5 |
| Ex. 5 | 〃 | 〃 | 〃 | 〃 | 〃 | 2.0 | 〃 | 〃 | 〃 | 〃 | 〃 | 〃 | 〃 | G5 |
| Ex. 6 | 〃 | 〃 | 〃 | 〃 | 〃 | 1.0 | 5 | 〃 | 〃 | 〃 | 〃 | 〃 | 〃 | G5 |
| Ex. 7 | 〃 | 〃 | 〃 | 〃 | 〃 | 〃 | 49 | 〃 | 〃 | 〃 | 〃 | 〃 | 〃 | G5 |
| Ex. 8 | 〃 | 〃 | 〃 | 〃 | 〃 | 〃 | 28 | 152 | 〃 | 〃 | 〃 | 〃 | 〃 | G5 |
| Ex. 9 | 〃 | 〃 | 〃 | 〃 | 〃 | 〃 | 〃 | 250 | 〃 | 〃 | 〃 | 〃 | 〃 | G5 |
| Ex. 10 | 〃 | 〃 | 〃 | 〃 | 〃 | 〃 | 〃 | 200 | 〃 | 〃 | 0.3 | 〃 | 〃 | 5 |
| Ex. 11 | 〃 | 〃 | 〃 | 〃 | 〃 | 〃 | 〃 | 〃 | 〃 | 〃 | 0.7 | 〃 | 〃 | G5 |
| Ex. 12 | 〃 | 〃 | 〃 | 〃 | 〃 | 〃 | 〃 | 〃 | 〃 | 〃 | 1.0 | 〃 | 〃 | G5 |
| Ex. 13 | 〃 | 〃 | 〃 | 〃 | 〃 | 〃 | 〃 | 〃 | 95 | 〃 | 0.5 | 〃 | 〃 | G5 |
| Ex. 14 | 〃 | Ar | 〃 | 〃 | 〃 | 〃 | 〃 | 〃 | 40 | 〃 | 0.5 | 〃 | 〃 | G5 |

DIECAST MACHINE AND DIECAST METHOD

CROSS REFERENCE TO RELATED APPLICATIONS

This application is based upon and claims the benefit of priority from prior Japanese Patent Application No. 2005-170055, filed on Jun. 9, 2005; the entire contents of which are incorporated herein by reference.

BACKGROUND OF THE INVENTION

1. Field of the Invention

This invention relates to a diecast machine to mold a molded product having an amorphous phase and to a diecast method.

2. Description of the Related Art

It has been previously known that even in the case that a specific group of alloys is subjected to cooling at the cooling rate equal to or less than 100° C./s, the specific group of alloys make glass transition to become an amorphous metal material (metallic glass) (for example, "Monthly Functional Material" CMC Publication, June/2002, Vol. 22, No. 6, pp. 5-9). The metal glass possesses amorphous properties such as high strength, low Young's modulus and high elastic limit, and it is expected that the metal glass is used widely as structural members.

As manufacturing methods of the metal glass, a water quenching method, an arc melting method, a permanent mold casting method, a high-pressure injection molding method, a vacuum casting method, a die locking casting method, a spinning disc reel method and the like can be cited. Moreover, it is known that the large shaped metal glass (bulky metallic glass) can be manufactured by use of these methods ("Monthly Functional Material" CMC Publication, June/2002, Vol. 22, No. 6, pp. 26-31).

As described above, it is expected that the metallic glass is used widely as the structural members and the structural members take generally complex shapes including concave or convex shapes in many cases. In the methods mentioned above, there has been a case that the metal material is not molded into the complex shape, and that the metal material did not become amorphous even when the metal material is molded into the complex shape.

Meanwhile, as a method of molding the metal material into the complex shape, a high-pressure die casting method which is generally used in molding a light metal is known. In addition, the high-pressure diecasting method is classified into a horizontal high-pressure diecasting method and a vertical (perpendicular) high-pressure diecasting method depending on injection direction of the heated metal material (melt).

Specifically, the horizontal high-pressure diecasting method can control the height of the diecast machine to be low, the structure of the diecast machine is simple and the diecast machine causes few damages. Therefore, the horizontal high-pressure diecasting method has become the mainstream of the high-pressure diecasting method which molds the light metal. Incidentally, in the horizontal high-pressure diecasting method, when an atmosphere within a sleeve is the air atmosphere, air (atmosphere) tends to be involved in injecting the melt (metal material). Therefore in general, the melt is injected after the air within the sleeve is exhausted by use of an air vent or a vacuum evacuation system. Moreover, in the horizontal high-pressure diecasting method, it is also performed that the air within the sleeve is exhausted by moving a plunger at low speed and the melt is injected by moving the plunger at high speed after filling the sleeve with the melt (metal material) (for example, Itsuo Ohnaka, one other "Melt-processibility" Corona Publishing, September/1987, pp 119-120).

On the other hand, in the vertical high-pressure diecasting method, a contact area of the melt (metal material) and the sleeve and a contact area of the melt and the air (atmosphere) within the sleeve are small. Therefore, according to the vertical high-pressure diecasting method it is easy to mold the thin-walled molded product with fine surface properties.

As a representative example of the vertical high-pressure diecasting method, a squeeze diecasting method to solidify the melt while applying a high-pressure of 50 MPa to 200 MPa on the melt can be cited. The squeeze diecasting method can mold the thin-walled molded product with fine surface properties, but can only mold a simple molded product taking a shape to allow pressure to be applied on the entire melt. Moreover, since high-pressure is applied in the squeeze diecasting method, a metal mold tends to be damaged. Therefore the squeeze diecasting method is used only for the case of molding special molded products (for example, Itsuo Ohnaka, one other, "Melt-processibility" Corona Publishing, September/1987, pp 120-122).

Furthermore, a method (vacuum diecasting method) has also been proposed, which prevents oxidation of the metal material at the time of applying heat on the metal material (Zr—Cu—Ni—Be) by creating vacuum inside the housing while covering surroundings of a dissolution chamber with the housing (for example, Japanese Patent Laid-open No. 1999-285801). According to the vacuum diecasting method, the molded products including amorphous phase equal to or above 50% of the total can be molded.

However, according to the prior art mentioned above (the horizontal diecasting method, the vertical diecasting method and the vacuum diecasting method), there has been the case that when the melt (metal material) is poured from a melting furnace into the sleeve, temperature of the melt is decreased and a heterogeneous nucleation is generated. In other words, according to the prior art mentioned above, it has been difficult to increase a ratio of the amorphous phase contained in the molded product due to incorporating crystals into the molded product.

SUMMARY OF THE INVENTION

An object of the present invention is to provide a diecast machine and a diecast method which can increase a ratio of an amorphous phase contained in a molded product.

According to an aspect of the invention, the diecast machine includes: a sleeve extending in vertical direction; a plunger moving upward in the vertical direction inside the sleeve; a mold disposed above an upper side of the sleeve; and a metal material heater to melt a metal material by heating the metal material disposed on the plunger.

According to this diecast machine, the metal material heater melts the metal material by heating the metal material disposed on the plunger, the diecast machine possible to suppress a decrease in temperature of a melt, since the metal material (melt) does not poured from a melting furnace into the sleeve.

Moreover, since the mold is disposed above the upper side of the sleeve extending in the vertical direction and the plunger is moved upward in the vertical direction inside the sleeve, the diecast machine can make an area small where the metal material (melt) contacts the inside of the sleeve, it is possible to suppress temperature decrease of the melt.

In other words, the diecast machine can increase the ratio of the amorphous phase contained in the molded product. According to the aspect of the invention, the diecast method comprises the steps of: melting the metal material by heating the metal material disposed inside the sleeve; injecting a melt inside a cavity by pushing the melt upward in a vertical direction, the melt being the metal material melted in the melting step; and solidifying the melt inside the cavity by cooling the melt.

BRIEF DESCRIPTION OF THE DRAWINGS

FIG. 7 is a table exhibiting quality of the molding according to a comparative example; and FIG. 8 is a table exhibiting quality of the molded product 300 according to the one embodiment of the present invention.

DETAILED DESCRIPTION OF THE INVENTION

A Diecast Machine According to one Embodiment of the Present Invention

Figure 1:
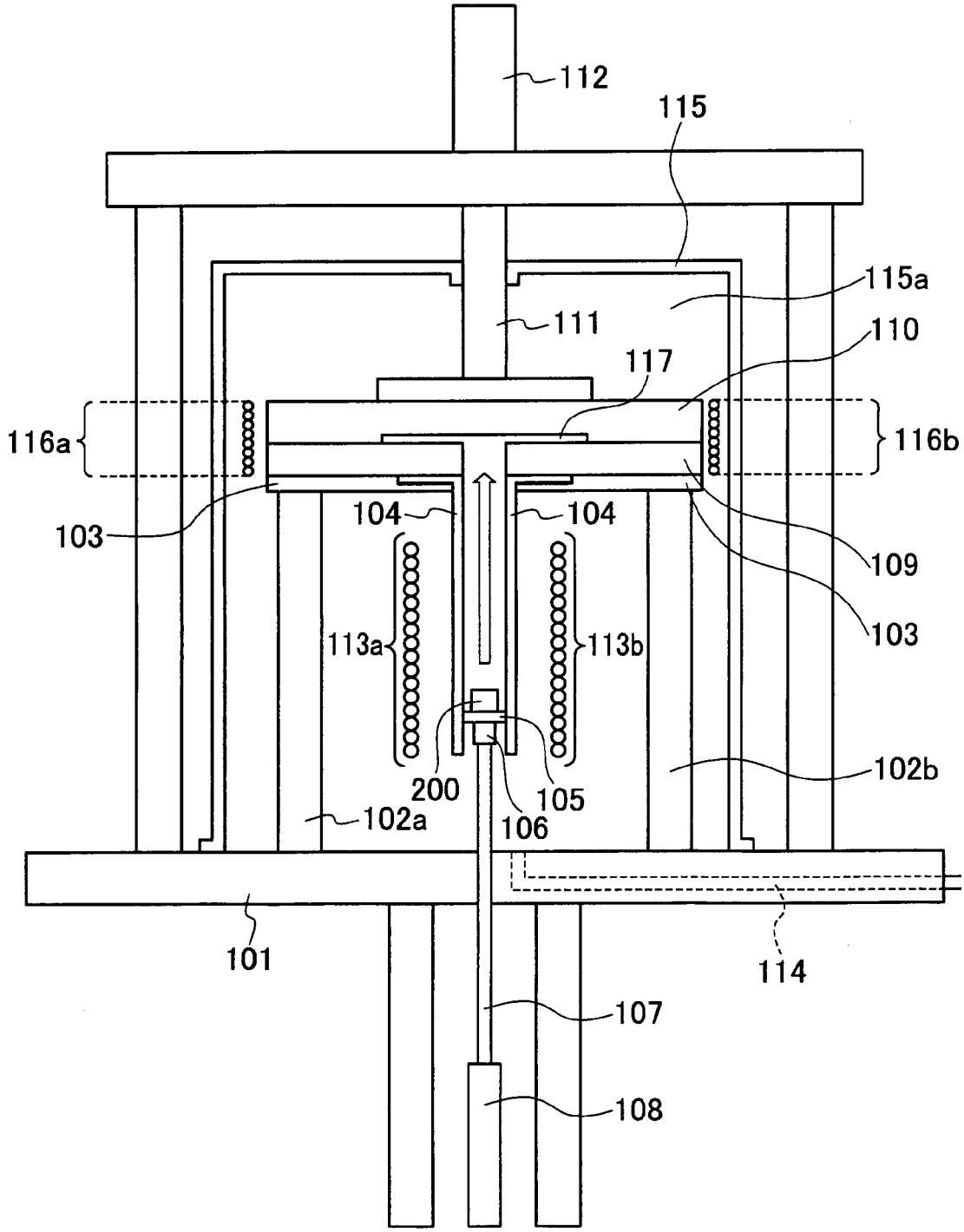
FIG. 1 is a diagram showing a diecast machine 100 according to one embodiment of the present invention.

Hereinafter, an explanation of the diecast machine according to one embodiment of the present invention will be given with reference to drawings. FIG. 1 is a diagram showing the diecast machine 100 according to the one embodiment of the present invention.

As shown in FIG. 1, the diecast machine 100 includes: a base unit 101; columns 102 (a column 102*a* and a column 102*b*); a sleeve supporting unit 103; a sleeve 104; a plunger tip 105; a reinforcing member 106; an injection rod 107; an injection cylinder 108; a lower mold 109; an upper mold 110; a mold locking rod 111; a mold locking cylinder 112; sleeve heaters 113 (a sleeve heater 113*a* and a sleeve heater 113*b*); a communicating pipe 114; a case member 115; and mold heaters 116 (a mold heater 116*a* and a mold heater 116*b*).

Moreover, a die cavity 117 is formed between the lower mold 109 and the upper mold 110 to manufacture a molded product (molded product 300 to be described later) by locking the upper mold 110. Furthermore, a material (metal material 200) for the molded product 300 is disposed on the plunger tip 105. Incidentally, the metal material 200 (molded product 300) is an alloy containing Zr base or Ti base.

The base unit 101 takes a shape like a plate. A plurality of the columns 102 extending in vertical direction and the case member 115 which covers the sleeve 104, the sleeve heaters 113 and the like are provided on the base unit 101.

The columns 102 take shapes extending in vertical direction and are provided on the base unit 101. Moreover, the columns 102 support the sleeve supporting unit 103 and the mold (the lower mold 109 and the upper mold 110).

The sleeve supporting unit 103 is supported by the columns 102 and is jointed to the lower mold 109. Moreover, the sleeve supporting unit 103 supports the sleeve 104 between the sleeve supporting unit 103 and the lower mold 109.

The sleeve 104 takes a shape extending in vertical direction. Here, it is preferable that the sleeve 104 is constituted of graphite, for example. Moreover, the sleeve 104 includes a plunger passage where the plunger moves up and down, inside the sleeve. Incidentally, the plunger is composed of the plunger tip 105, the reinforcing member 106 and the injection rod 107 and is the member to inject the metal material 200 into the die cavity 117 by moving in vertical direction inside the sleeve 104.

It is preferable that the plunger tip 105 is constituted of the graphite, for example. Additionally, the metal material 200 is disposed on the plunger tip 105.

Here, the reason why the graphite is selected as materials of the sleeve 104 and the plunger tip 105 is because the metal material 200 (melt) melted by the sleeve heaters 113 and the plunger tip 105 maintain a proper thermal conductivity without causing a reaction between them. The reason further is because by maintaining the proper thermal conductivity, laminar flow of the metal material 200 is maintained while suppressing a speed (injection speed) to inject the metal material 200. The reason is furthermore because a clearance between an inner wall of the sleeve 104 (an inner wall 104*a* to be described later) and the plunger tip 105 is reduced due to slidable property possessed by the graphite.

The reinforcing member 106 is the member to reinforce the injection rod 107 so that the injection rod 107 is not broken when applying pressure on the metal material 200. In addition, the plunger tip 105 is standing still on the reinforcing member 106 without being jointed thereto.

The upper end of the injection rod 107 is jointed to the reinforcing member 106 and the lower end of the injection rod 107 is installed inside the injection cylinder 108. Moreover, the injection rod 107 moves upward and downward inside the sleeve 104 (plunger passage).

The injection cylinder 108 is the cylinder to move the injection rod 107 in vertical direction. Here, this cylinder is, for example, a hydraulic cylinder. Specifically, the injection cylinder 108 extrudes the metal material 200 disposed on the plunger tip 105 upward in vertical direction by moving the injection rod 107 upward in vertical direction, while injecting the metal material 200 (melt) into the die cavity 117.

Here, it is preferable that the injection cylinder 108 move the injection rod 107 upward in vertical direction at the speed of approximately 0.1 m/sec to 2 m/sec. In other words, it is preferable to set the speed (injection speed) to inject the metal material 200 at a speed within a range from 0.1 m/sec to 2 m/sec.

The reason of setting the injection speed within the range of approximately 0.1 m/sec to 2 m/sec is to prevent solidification of the metal material 200 (melt) melted by the sleeve heaters 113 inside the sleeve 104 attributable to too slow injection speed. Moreover, the reason is to prevent occurrence of the turbulent flow of the melt inside the sleeve 104 and to maintain laminar flow of the melt attributable to too large injection speed.

Furthermore, it is preferable that the injection cylinder 108 moves the injection rod 107 upward in vertical direction so that a pressure of approximately 5 MPa to 50 MPa is applied on the metal material 200 (melt) melted by the sleeve heaters 113. In other words, the pressure (plunger pressure) to be applied on the metal material 200 (melt) is preferably set within a range of approximately 5 MPa to 50 MPa, The reason of setting the pressure (plunger pressure) applied on the metal material 200 (melt) within the range of 5 MPa to 50 MPa is to fill the inside of the die cavity 117 with the metal material 200 (melt) sufficiently and to reduce the pressure applied on the mold (the lower mold 109 and the upper mold 110).

The lower mold 109 and the upper mold 110 comprise the mold to mold the metal material 200. Specifically, the lower mold 109 and the upper mold 110 form the die cavity 117 by locking the upper mold 110, as described above.

Here, the lower mold 109 and the upper mold 110 are preferably constituted of metal (including alloy) having a thermal conductivity of approximately 20 W/mK to 120 W/mK.

The reason of setting the thermal conductivity of the mold to approximately 20 W/mK to 120 W/mK is to facilitate thermal adjustment of the mold by setting the thermal conductivity of the mold equal to or above approximately 20 W/mK and to prevent solidification of the metal material 200 (melt) inside the mold attributable to rapid cooling of the mold by setting the thermal conductivity of the mold equal to or below approximately 120 W/mK.

The upper end of the mold locking rod 111 is installed inside the mold locking cylinder 112, and the lower end of the mold locking rod 111 is jointed to the upper mold 110. In addition, the mold locking rod 111 moves upward and downward.

The mold locking cylinder 112 is the cylinder to move the mold locking rod 111 up and down. Here, this cylinder is a hydraulic cylinder, for example. Specifically, the mold locking cylinder 112 locks the upper mold 110 to the lower mold 109 by moving the mold locking rod 111 downward.

The sleeve heaters 113 melt the metal material 200 by heating the metal material 200 (the metal material 200 disposed on the plunger tip 105) disposed inside the sleeve 104 to approximately 1200° C. Incidentally, the sleeve heaters 113 are composed of a high frequency coil, a YAG laser and the like.

The communicating pipe 114 connects the inside of a closed space 115*a* which is formed by the base unit 101 and the case member 115 with the outside of the closed space 115*a*. Moreover, the communicating pipe 114 is used when exhausting the air (atmosphere) inside the closed space 115*a* by use of a vacuum exhaust apparatus (not illustrated) and the like.

In addition, the communicating pipe 114 may be used not only for exhausting the air inside the closed space 115*a* but also for substituting the air (atmosphere) inside the closed space 115*a* for inert gasses.

The case member 115 is the member to cover the sleeve 104, the mold (the lower mold 109 and the upper mold 110), the plunger tip 105, the sleeve heaters 113 and the mold heater 116 and to cause the space including these units to be a closed space 115*a*. Specifically, the case member 115 is provided on the base unit 101 and forms the closed space 115*a* together with the base unit 101.

Incidentally, in this embodiment the closed space 115*a* is formed by the base unit 101 and the case member 115. However, the embodiment is not limited to this and the closed space may be formed only by the case member 115.

It is preferable that the mold heater 116 heat the mold (the lower mold 109 and the upper mold 110) and maintain a temperature of the lower mold 109 and the upper mold 110 within a range from approximately 150° C. to 250° C. Incidentally, the mold heater 116 is composed of an electric furnace, the high frequency coil, the YAG laser and the like. In addition, the mold heater 116 is not necessarily provided outside the mold and may be a cartridge heater to be inserted inside the mold.

Here, the reason of maintaining the temperature of the mold (the lower mold 109 and the upper mold 110) within the range from approximately 150° C. to 250° C. is to prevent solidification of the metal material 200 (melt) attributable to too low mold temperature before the die cavity 117 is filled with the metal material 200 (melt) and to prevent no progress of solidification of the metal material 200 (melt) attributable to too high mold temperature.

The die cavity 117 is a space formed by the lower mold 109 and the upper mold 110 by locking the upper mold 110. Moreover, the metal material 200 is injected inside the die cavity 117 by the plunger and the metal material 200 is molded in accordance with the shape of the die cavity 117. Furthermore, the die cavity 117 takes a shape extending in horizontal direction.

In this way, the reason why the mold is comprised of the lower mold 109 and the upper mold 110 and the lower mold 109 and the upper mold 110 form the die cavity 117 extending in horizontal direction is because the melt injected inside the die cavity 117 flows uniformly without opposing gravity in comparison with the case that the die cavity 117 takes a shape extending in vertical direction.

Figure 2:
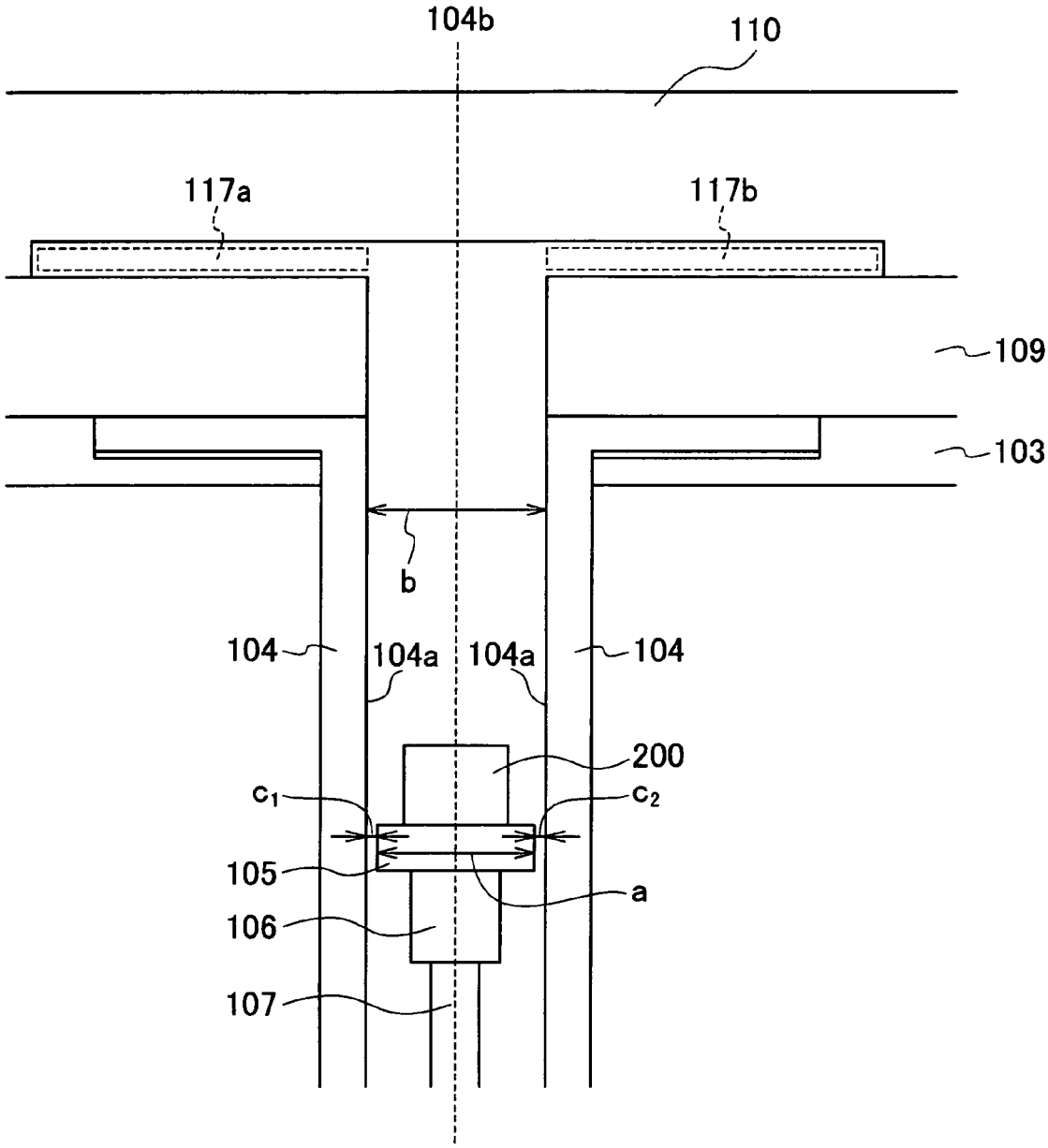
FIG. 2 is an enlarged view of a perimeter of a plunger tip 105 according to the one embodiment of the present invention.

FIG. 2 is an enlarged view of the perimeter of the plunger tip 105 according to the one embodiment of the present invention. As shown in FIG. 2, it is preferable that distances (distance c1 and distance c2) between an inner wall 104*a* of the sleeve 104 and the plunger tip 105 are equal to or less than approximately 0.01 mm. In other words, it is preferable that tolerance of one side dimension (clearance; namely a space in radial direction) between an external diameter a of the plunger tip 105 and an inner diameter b of the sleeve 104 is equal to or less than approximately 0.01 mm.

Moreover, the lower mold 109 and the upper mold 110 form the die cavity 117 taking a shape extending in the horizontal direction by locking the upper mold 110 onto the lower mold 109. Furthermore, the lower mold 109 and the upper mold 110 form a plurality of cavities (a first cavity 117*a* and a second cavity 117*b*) which are mutually symmetric relative to a center line 104*b* of the sleeve 104 extending in the vertical direction.

Here, the reason why the first cavity 117*a* and the second cavity 117*b* are mutually symmetric relative to the center line 104*b* of the sleeve 104 extending in the vertical direction is because flows of the melt injected inside the die cavities 117 are also mutually symmetric relative to the center line 104*b* and a plurality of the molded products 300 with high ratio of the amorphous phase are molded efficiently.

A Molded Product According to one Embodiment of the Present Invention

Figure 3:
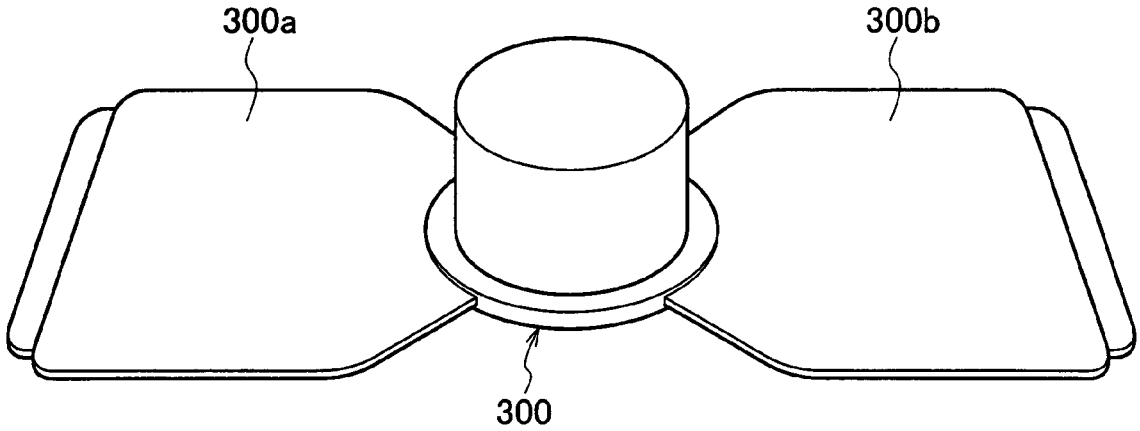
FIG. 3 is a diagram showing a molded product 300 according to the one embodiment of the present invention.

Hereinafter, the molded product according to the one embodiment of the present invention will be explained with reference to the drawing. FIG. 3 is a diagram showing the molded product 300 according to the one embodiment of the present invention.

As shown in FIG. 3, the molded product 300 is molded by the metal material 200 which is an alloy containing Zr base or Ti base in accordance with the shape of the die cavity 117 mentioned above. Specifically, the molded product 300 includes: a first molded part 300*a* which is the part molded in accordance with the shape of the first cavity 117*a* extending in the horizontal direction; and a second molded part 300*b* which is the part molded in accordance with the shape of the second cavity 117*b* extending in the horizontal direction.

A Diecast Method According to one Embodiment of the Present Invention

Figure 4:
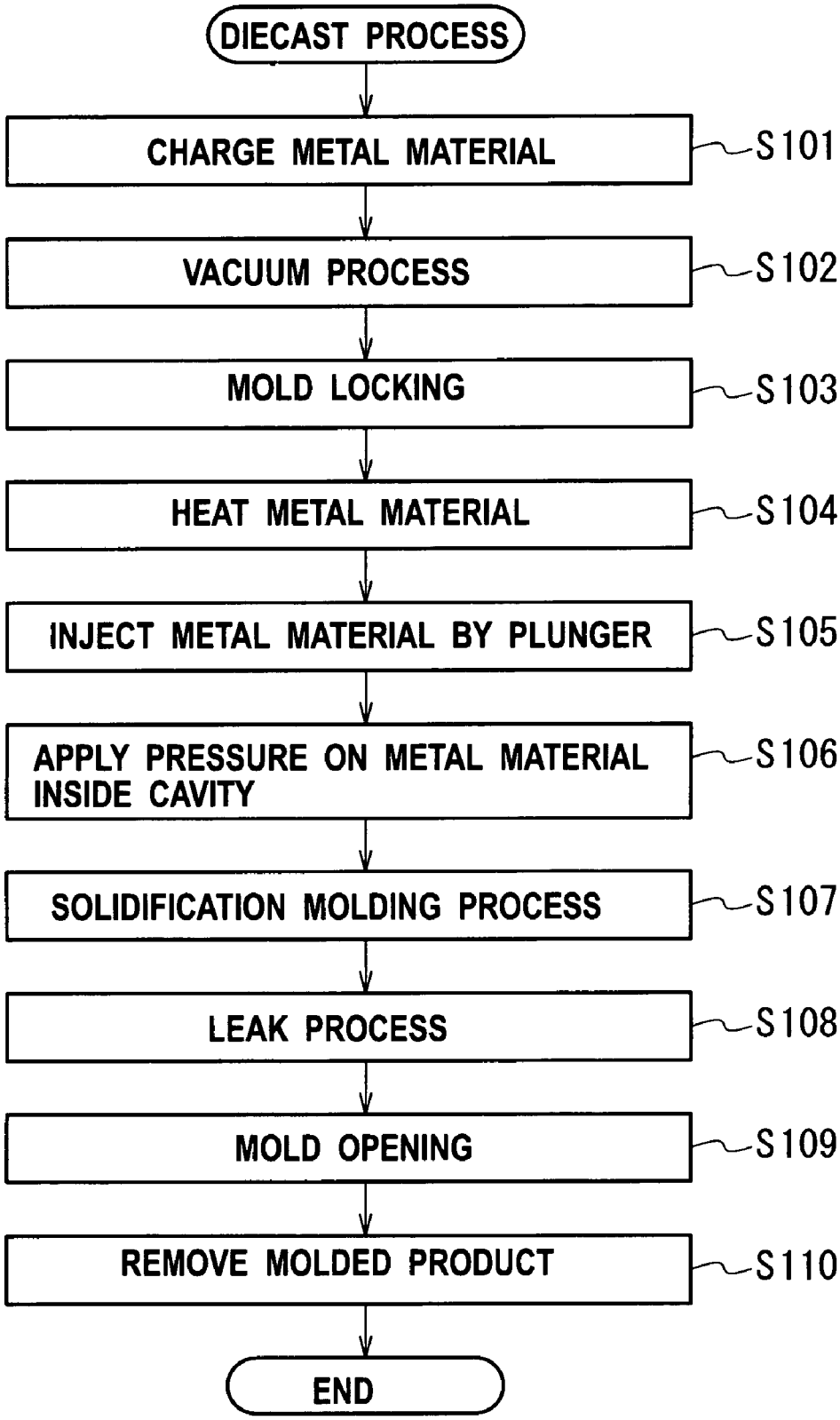
FIG. 4 is a flowchart showing a diecast method according to the one embodiment of the present invention.

Hereinafter, the diecast method according to the one embodiment of the present invention will be explained with reference to the drawing. FIG. 4 is a flowchart of the diecast method according to the one embodiment of the present invention.

As shown in FIG. 4, the metal material 200 is disposed on the plunger tip 105 in step 101.

In step 102, the diecast machine 100 exhausts the air (atmosphere) inside the closed space 115*a* through above mentioned communicating pipe 114 and creates a vacuum inside the closed space 115*a*.

In step 103, the diecast machine 100 locks the upper mold 110 to the lower mold 109 by moving the mold locking rod 111 downward.

In step 104, the diecast machine 100 melts the metal material 200 on the plunger tip 105 by heating the metal material 200 to approximately 1200° C. by use of the sleeve heaters 113.

In step 105, the diecast machine 100 injects the metal material 200 (melt) upward in the vertical direction by moving the plunger tip 105 upward in the vertical direction. Here, it is preferable that the diecast machine 100 injects the metal material 200 (melt) at the speed of approximately 0.1 m/sec to 2 m/sec.

In step 106, the diecast machine 100 applies pressure on the metal material 200 (melt) injected inside the die cavity 117. Here, it is preferable that the diecast machine 100 applies pressure of approximately 5 MPa to 50 MPa on the metal material 200 (melt).

In step 107, the diecast machine 100 solidifies the metal material 200 (melt) by cooling the metal material 200 (melt) injected inside the die cavity 117. Here, it is preferable that the diecast machine 100 maintains a temperature of the mold within a range from approximately 150° C. to 250° C.

Instep 108, the diecast machine 100 introduces atmosphere inside the closed space 115*a* through the communicating pipe 114 (leak process) and returns the pressure inside the closed space 115*a* at atmospheric pressure.

In step 109, the diecast machine 100 mold-opens the upper mold 110 from the lower mold 109 by moving the mold locking rod 111 upward.

In step 110, the molded product 300 molded inside the die cavity 117 is removed.

According to the diecast machine 100 of the one embodiment of the present invention, the sleeve heaters 113 heats the metal material 200 disposed on the plunger (plunger tip 105) and melts the metal material 200. Therefore, the diecast machine 100 can suppress a temperature reduction of the melt without a necessity to flow the metal material 200 (melt) from the melting furnace into the sleeve 104.

That is to say, the diecast machine 100 can increase the ratio of the amorphous phase contained in the molded product 300.

Moreover, the case member 115 covers the sleeve 104, the lower mold 109, the upper mold 110 and the sleeve heaters 113, and causes the space including these parts to be the closed space 115*a*. The communicating pipe 114 connects the inside of the closed space 115*a* with the outside of the closed space 115*a*. Accordingly, the diecast machine 100 can cause the inside of the closed space 115*a* to be vacuum by exhausting the air (atmosphere) inside the closed space 115*a* and can substitute the air (atmosphere) inside the closed space 115*a* for inert gasses.

In other words, the diecast machine 100 can suppress oxidation of the metal material 200 when melting the metal material 200.

Moreover, since the lower mold 109 and the upper mold 110 form the die cavity 117 taking the shape extending in the horizontal direction, it is possible to flow the melt injected inside the die cavity 117 uniformly in comparison with the case that the die cavity takes the shape extending in the vertical direction.

That is to say, the diecast machine 100 can suppress progress of crystallization attributable to heterogeneous flow of the melt and can increase the ratio of the amorphous phase contained in the molded product 300.

Moreover, the lower mold 109 and the upper mold 110 form the first cavity 117*a* and the second cavity 117*b* which are mutually symmetric relative to the center line 104*b* of the sleeve 104 extending in the vertical direction. As a result, the flows of the melt injected inside the die cavity 117 are mutually symmetric relative to the center line 104*b* and the diecast machine 100 can mold a plurality of the molded products 300 with high ratio of the amorphous phase efficiently.

Furthermore, the plunger (the injection rod 107 and the plunger tip 105) move inside the sleeve 104 at the speed from 0.1 m/sec to 2 m/sec upward in the vertical direction. Accordingly, the diecast machine 100 can inject the melt while suppressing turbulent flow of the metal material 200 (melt) melted inside the sleeve (that is, while maintaining laminar flow of the melt).

In addition, the plunger (the injection rod 107 and the plunger tip 105) applies pressure from 5 MPa to 50 MPa on the metal material 200 (melt) injected inside the die cavity 117. As a result, the diecast machine 100 can fill the inside of the die cavity 117 with the melt sufficiently and can suppress the pressure applied on the mold (the lower mold 109 and the upper mold 110).

Moreover, the mold heater 116 maintains the temperature of the mold (the lower mold 109 and the upper mold 110) within the range from 150° C. to 250° C. Therefore, the diecast machine 100 can prevent solidification of the metal material 200 (melt) attributable to too low mold temperature before the die cavity 117 is filled with the metal material. It can also prevent no progress of solidification of the metal material 200 (melt) attributable to too high mold temperature.

In addition, since the thermal conductivity of the mold (the lower mold 109 and the upper mold 110) is set within the range from 20 W/mK to 120 W/mK, it is possible to facilitate thermal adjustment of the mold and prevent solidification of the metal material 200 (melt) inside the mold.

Moreover, the diecast machine 100 can maintain a proper thermal conductivity without causing a reaction of the metal material 200 (melt) melted by the sleeve heaters 113 and the plunger tip 105 by selecting the graphite as the material for the sleeve 104 and the plunger tip 105. Furthermore, the diecast machine 100 can suppress the injection speed of the metal material 200 and can maintain laminar flow of the metal material 200 by maintaining the proper thermal conductivity. Still furthermore, the one side distance (c1 and c2) between the inner wall of the sleeve 104 (an inner wall 104*a* to be described later) and the plunger tip 105 can be set equal to or less than 0.01 mm.

Additionally, by setting the one side distance (c1 and c2) between the inner wall of the sleeve 104 and the plunger tip 105 equal to or less than 0.01 mm, even when the sleeve 104 takes the shape extending in the vertical direction, it is possible to suppress downward leakage of the metal material 200 (melt).

As explained above, the present invention was explained in detail with reference to the example. However, it is obvious to those skilled in the art that the present invention is not intended to be limited to the embodiment explained in this application. Various changes and modifications may be made to diecast machine and diecast method of the present invention without departing from the spirit and the scope of the present invention being indicated by the description of the appended claims, and the invention may be embodied in other forms. Therefore, the description of this application is intended to explain the examples and does not have any limited meanings to the present invention.

EXAMPLES

Figure 5:
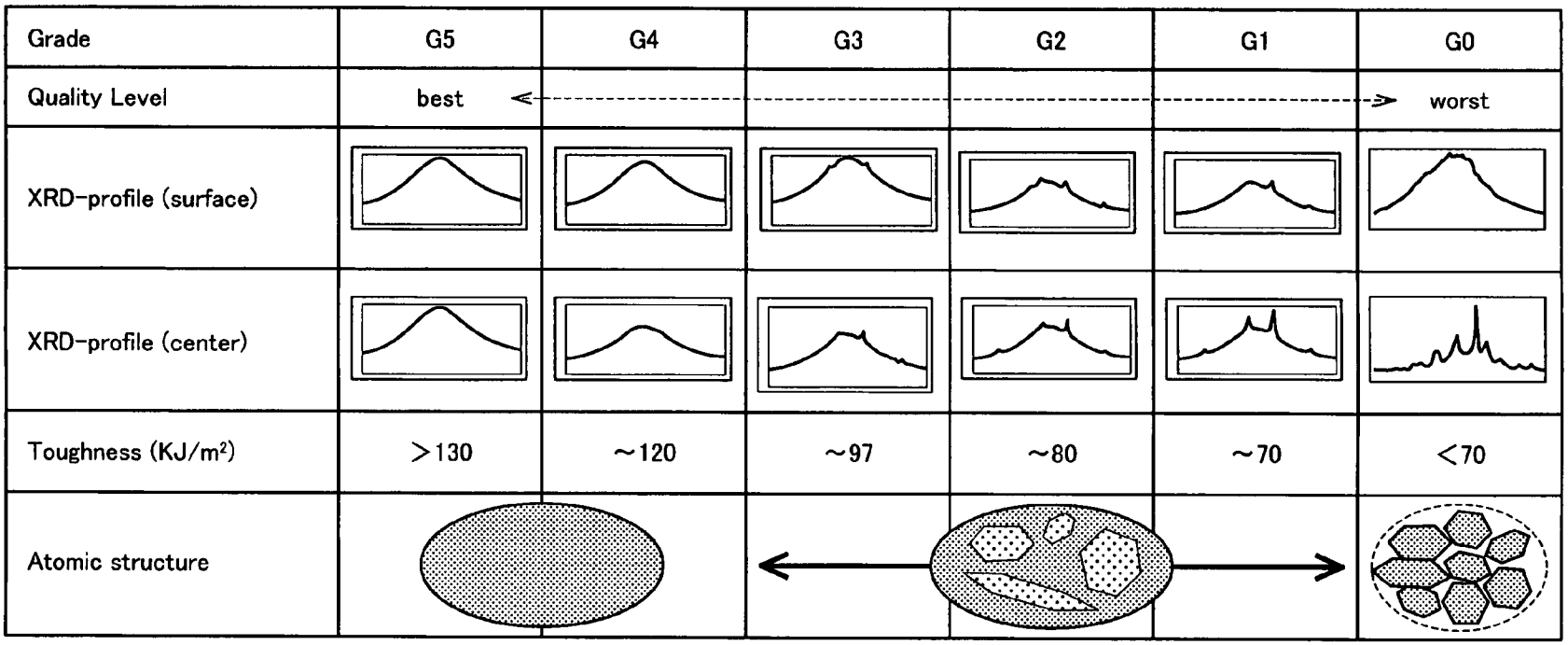
FIG. 5 is a diagram exhibiting criteria to evaluate an amorphous degree according to the one embodiment of the present invention.

Hereinafter, one example of the present invention will be explained with reference to drawings. Firstly, criteria (evaluation criteria) to evaluate an amorphous degree according to the embodiment of the present invention will be explained with reference to the drawing. FIG. 5 is a diagram exhibiting criteria to evaluate the amorphous degree according to the one embodiment of the present invention.

As shown in FIG. 5, measurement results (XRD-Profile) by XRD method (X-Ray Diffractometer) and toughness of the molded product were adopted as evaluation criteria. Specifically, the molded product which had no sharp peak appearing in the XRD-profile and had the toughness greater than 130 $KJ/m^2$ was evaluated at "G5". On the other hand, the molded product which had sharp peak in the XRD-profile and had the toughness less than 70 $KJ/m^2$ was evaluated at "G0".

Figure 6A:
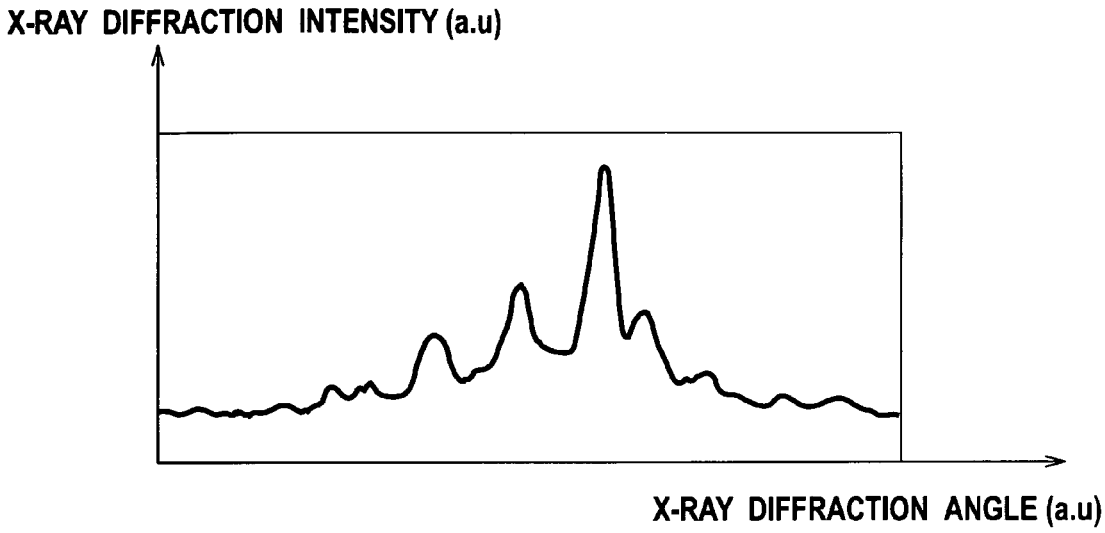
FIGS. 6A and 6B are graphs depicting one example of XRD-Profile of the molding.
Figure 6B:
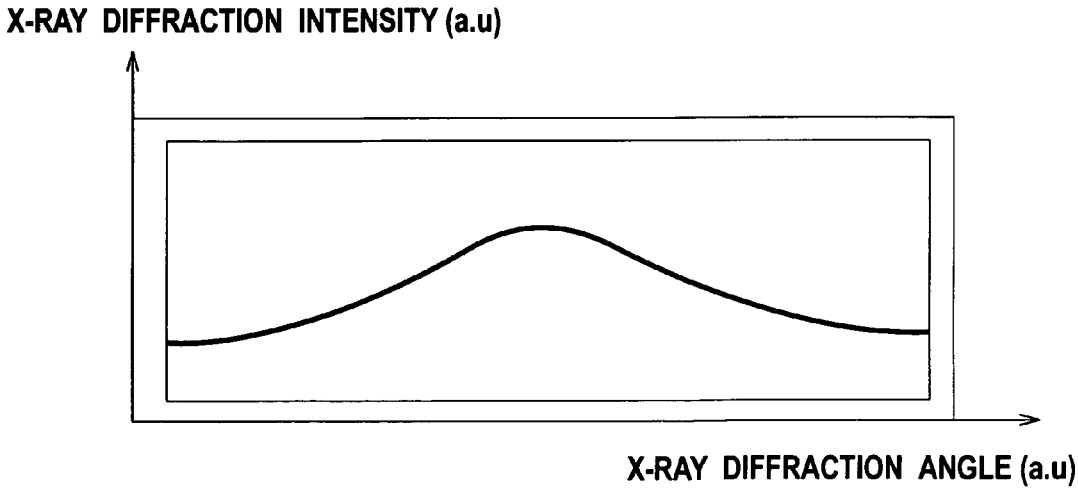

Next, one example of the XRD-profile will be explained with reference to the drawings. FIG. 6A is a graph depicting XRD-Profile of the molded product evaluated at "G0". FIG. 6B is a graph depicting XRD-Profile of the molded product evaluated at "G5".

As shown in FIG. 6A, the molded product which had the sharp peak in the XRD-profile was evaluated at "G0" which indicates the lowest amorphous degree in accordance with the above mentioned evaluation criteria. On the other hand, as shown in FIG. 6B, the molded product which had no sharp peak in the XRD-profile was evaluated at "G5" which indicates the highest amorphous degree in accordance with the above mentioned evaluation criteria.

Next, quality of the molded product according to the comparative examples will be explained with reference to the drawing. FIG. 7 is a table exhibiting quality of the molded product according to the comparative example. Note that specifically, in the comparative example an alloy of Zr (55%)—Cu (30%)—Al (10%)—Ni (5%) was melted at 1200° C., thereafter the melted alloy (melt) was poured into the sleeve and the melt was injected inside the cavity.

As shown in FIG. 7, the molded product could not be molded in the following cases: the case that atmosphere inside the sleeve was the air atmosphere (comparative example 2); the case that dimension tolerance (clearance) between the sleeve and the plunger tip was large (comparative example 4); and the case that injection speed of the melt by the plunger was slow (comparative example 5).

Moreover, appearance quality of the molded product was defective in the following cases: the case that die steel was used as the materials of the sleeve and the plunger tip (comparative example 3), the case that pressure (plunger pressure) applied on the melt by the plunger was small (comparative example 7); the case that the mold temperature was not proper (comparative examples 9 and 10); and the case that thermal conductivity of the mold was too high (comparative example 11).

Furthermore, the molded product did not become amorphous in the following cases: the case that injection direction of the melt was in the horizontal direction (comparative examples 1 and 12); and the case that speed (injection speed) to inject the melt by the plunger was too high (comparative example 6).

In addition, in the comparative example 8, the appearance quality of the molded product was fine and the molded product became amorphous. However, since the plunger pressure was 70 MPa, which was large, the pressure (load) applied on the mold became large and increased possibility of causing damage to the mold.

In this way, as shown in the comparative examples 1 to 12, when the metal material (alloy) was melted, then poured into the sleeve and the melt inside the sleeve was injected, it was impossible to mold the molded product having fine appearance quality and high ratio of the amorphous phase while suppressing the pressure applied on the mold.

Finally, quality of the molded product 300 according to the one embodiment of the present invention will be explained with reference to the drawing. FIG. 8 is a table exhibiting quality of the molded product 300 according to the one embodiment of the present invention. Note that in the one embodiment of the present invention the alloy of Zr (55%)—Cu (30%)—Al (10%)—Ni (5%) was melted by heating up to 1200° C. on the plunger, thereafter the melted alloy (melt) was injected inside the cavity.

As shown in FIG. 8, in the embodiment examples 1 to 14, it was possible to mold the molded product having fine appearance quality and high ratio of the amorphous phase while suppressing the pressure (plunger pressure) applied on the mold.

What is claimed is:

1. A diecast method, comprising the steps of:

providing a plunger having a graphite plunger tip disposed at an upper end thereof, the plunger moving upward in a vertical direction inside a graphite sleeve extending in a vertical direction, the graphite sleeve having a flange extending in a horizontal direction at an upper end thereof;

providing a mold disposed above the graphite sleeve, the mold being separated into an upper mold and a lower mold in the vertical direction, and the upper mold and the lower mold forming a die cavity extending in a horizontal direction, wherein the flange of the graphite sleeve is connected to the lower mold in the horizontal direction;

melting an amorphous metal material by heating the amorphous metal material disposed on the graphite plunger tip within the graphite sleeve;

maintaining a mold temperature in a range of approximately 150° C. to 250° C.;

injecting the melted amorphous metal material inside the die cavity by pushing the plunger holding the melted amorphous metal material upward in the vertical direction at a speed of 0.1 m/sec to 2 m/sec and while applying a pressure of 5 MPa to 50 MPa on the melted amorphous metal material; and solidifying the melted amorphous metal material inside the die cavity by cooling.

* * * * *